US005486120A

United States Patent [19]

McMills et al.

[11] Patent Number: 5,486,120

[45] Date of Patent: Jan. 23, 1996

[54] COAXIAL CABLE CONNECTION PROTECTION SYSTEM WITH MULTIPLE CHAMBERED, FLEXIBLE-WEBBED SHROUD

[75] Inventors: Corey McMills, Los Altos; John Mattis, Sunnyvale, both of Calif.; Dieter Fremgen, Wulfrath, Germany

[73] Assignee: Raychem Corporation, Menlo Park, Calif.

[21] Appl. No.: 106,276

[22] Filed: Aug. 13, 1993

Related U.S. Application Data

[63] Continuation-in-part of Ser. No. 911,427, Jul. 10, 1992, Pat. No. 5,277,598.

[51] Int. Cl.[6] ..... H01R 14/639; H01R 17/04

[52] U.S. Cl. ..... 439/521; 439/306

[58] Field of Search ..... 439/133, 521, 439/199, 204, 578, 936, 590, 304, 306–309

[56] References Cited

U.S. PATENT DOCUMENTS

| | | | |
|---|---|---|---|
| 2,805,399 | 9/1957 | Leeper | 333/6 |
| 3,196,382 | 7/1965 | Morello, Jr. . | |
| 3,264,602 | 8/1966 | Schwartz . | |
| 3,550,064 | 12/1970 | Caller et al. . | |
| 3,697,930 | 10/1972 | Shirey . | |
| 3,710,005 | 1/1973 | French | 174/89 |
| 3,731,378 | 5/1973 | Toma et al. . | |
| 3,781,762 | 12/1973 | Quackenbush . | |
| 3,963,321 | 6/1976 | Burger et al. . | |
| 4,053,195 | 10/1977 | Laverick et al. | 439/308 |
| 4,053,200 | 10/1977 | Pugner . | |
| 4,168,921 | 9/1979 | Blanchard | 439/133 |
| 4,173,385 | 11/1979 | Fenn et al. . | |
| 4,214,361 | 7/1980 | Coldren et al. | 439/937 |
| 4,249,790 | 2/1981 | Ito et al. . | |
| 4,583,811 | 4/1986 | McMills . | |
| 4,674,813 | 6/1987 | Feldner | 439/133 |
| 4,789,355 | 12/1988 | Lee | 439/584 |
| 4,806,116 | 2/1989 | Ackerman | 439/304 |
| 4,824,386 | 4/1989 | Sonders | 439/133 |
| 4,834,675 | 5/1989 | Samishisen | 439/578 |
| 4,998,894 | 3/1991 | Gronvall | 439/133 |
| 5,055,060 | 10/1991 | Down et al. | 439/304 |
| 5,066,248 | 11/1991 | Gaver et al. | 439/578 |
| 5,277,598 | 1/1994 | McMills et al. | 439/133 |
| 5,297,972 | 3/1994 | McMills et al. | 439/133 |

FOREIGN PATENT DOCUMENTS

| | | |
|---|---|---|
| 0197688A3 | 10/1986 | European Pat. Off. . |
| 0203263A3 | 12/1986 | European Pat. Off. . |
| 1565981 | 4/1966 | Germany . |
| 621459 | 4/1949 | United Kingdom . |
| 2013420 | 8/1979 | United Kingdom . |

*Primary Examiner*—Neil Abrams

*Attorney, Agent, or Firm*—Herbert G. Burkard; A. Stephen Zavell

[57] ABSTRACT

A device is provided for firmly attaching a plurality of coaxial cable terminus to a plurality of standard connection jacks in such a way that each connection point is effectively shielded from tampering by individuals and is effectively sealed from degrading elements in the atmosphere. The device is a locking shroud which defines a plurality of locking shroud chambers, each being adapted to attach to a respective connection jack so as to surround the connection of a cable terminus to the jack. Each locking shroud chamber is attached to one other locking shroud chamber by a flexible web disposed in a curved plane. Because of the flexible webs, the locking shroud can be easily adjusted to fit any standard coaxial cable multiple connection equipment. The use of the locking shroud of the invention makes it difficult to de-attach and/or re-attach the cable terminus to the jack without special tooling. The use of the locking shroud further makes it difficult to break off the locking shroud by twisting the shroud, such as with a pair of pliers. The device can be used to make coaxial cable connections secure from tampering and atmospheric degradation. It is simple and inexpensive to install and maintain. Furthermore, the system can be retrofitted into existing coaxial cable equipment, using standard coaxial cable connection jacks.

9 Claims, 15 Drawing Sheets

COAXIAL CABLE CONNECTION PROTECTION SYSTEM WITH MULTIPLE CHAMBERED, FLEXIBLE-WEBBED SHROUD

This application is a continuation-in-part of U.S. patent application Ser. No. 07/911,427, filed Jul. 10, 1992, now U.S. Pat. No. 5,277,598.

This application incorporates herein completely the entirety of U.S. patent application Ser. No. 07/911,427, filed Jul. 10, 1992, now U.S. Pat. No. 5,277,598, U.S. patent application Ser. No. 07/897,621, filed Jun. 11, 1992, now U.S. Pat. No. 5,207,602, U.S. patent application Ser. No. 07/509,669, filed Apr. 19, 1990, now U.S. Pat. No. 5,127,853, U.S. patent application Ser. No. 07/434,068, filed Nov. 8, 1989 now abandoned and U.S. patent application Ser. No. 07/364,917, filed Jun. 9, 1989 now abandoned.

FIELD OF THE INVENTION

This invention relates generally to devices and methods for connecting the terminus of a coaxial cable to a standard coaxial cable connection jack, and, specifically, to devices and methods for connecting the terminus of a coaxial cable to a standard coaxial cable connection jack in such a way that the connection point is protected from ambient conditions and from unauthorized tampering.

BACKGROUND OF THE INVENTION

Coaxial cable is in widespread use for distributing wide band radio frequency information, such as television and radio signals. The cable television/radio industry, which relies almost exclusively on coaxial cable, is one of the most rapidly expanding segments of the United States' economy. It is anticipated that in the very near future the amount and type of information available via coaxial cable networks will be greatly expanded beyond traditional television and radio signals. By the early part of the twenty-first century, coaxial cable networks may be the principal vehicle by which consumers obtain their daily news, access library information, do their shopping, pay their bills, and otherwise interact with much of the outside world. Maintaining and controlling the integrity of the coaxial cable distribution networks which will carry such a large amount and such a wide variety of consumer information and services is a major challenge for the cable network industry.

Coaxial cable typically includes a pair of conductors, a central axial conductor and an outer conductor which is disposed concentrically around the central conductor. A low-loss, high dielectric insulation material, such as plastic foam, is used to separate the two conductors. An outer insulating jacket is often provided over the concentric conductor to provide electrical insulation and physical protection to the cable. The concentric conductor may be a single continuous element or, more commonly, it is a composite of several layered elements of conductive foil, wire braid or similar material.

For ease of initial installation and for flexibility with respect to subsequent modifications, coaxial cable networks comprise lengths of cable connected to one another by some sort of connection equipment. In most coaxial cable networks, such connection equipment takes the form of a male/female connection system wherein the male member is provided by a connection jack and the female member is provided by a threaded or friction-fit coupler dimensioned to attach over the jack. A standard connection jack comprises a cylindrical, externally threaded body having an outside diameter of about 0.375 inches. The outwardly projecting end of the jack is covered by a planar member which has a central aperture. Behind the aperture, within the confines of the body of the jack, is disposed an internal conductor which is shielded from the body. The body is electrically connected to one of the coaxial cable circuits and the inner conductor is connected to the other coaxial cable circuit.

The female member in the typical male/female connection system commonly comprises a jack connection moiety which is adapted to attach to the cable connection jack. The female member also comprises a cable connection moiety which physically attaches to the terminus of a coaxial cable in such a way that the cable connection moiety is in electrical contact with the concentric conductor of the coaxial cable. The cable connection moiety is adapted to allow the terminus of the central conductor to project through the center of the female member without contacting the female member, so that, when the jack moiety is attached to the outside of the conductor jack body, the central conductor terminus protrudes into the connection jack central aperture (without contacting the jack connection moiety of the female member or the conductor jack body) and is placed into electrical contact with the internal conductor of the connection jack.

Coaxial cable networks are traditionally distributed to individual residences using existing telephone company poles and underground conduits. A coaxial cable "trunk" is run through a neighborhood in parallel with telephone and electrical lines, and each residence to be serviced by the cable network is connected into ("tapped into") the trunk line. The interface between the trunk line tap and the cable line running to an individual residence (the "drop line") is traditionally called a "tap block." A tap block traditionally is a small metal box having a flat face plate called a "tap plate." Projecting outwardly from the tap plate are several coaxial cable connection jacks. Each cable service-subscribing residence in the immediate vicinity of the tap block is connected to one of the connection jacks on the tap plate.

Typically, all of the services provided by the cable network company are available at the tap face connection jacks. If a residence chooses not to pay for certain special cable network services (such as the HBO television network and the Pay-Per-View television network), a "signal trap" is interposed between the tap face connection jack and the drop line for that individual residence. A signal trap is a small electrical device having an input connector jack and an output connector jack. The signal trap is electrically configured so as to filter out or scramble the signal of a non-subscribed-to cable service.

From the tap block, a drop line is run to each individual residence and is connected to individual "receivers" (i.e., televisions or radios). Where more than one receiver is used by the residence, the drop line will terminate at a "signal splitter" having one input connection jack and two or more output connection jacks. It is common practice for many coaxial cable networks to charge an additional subscriber fee for the use of signal splitters to connect up additional receiving devices.

The problem with the use of such typical coaxial cable connection equipment is that such equipment is easy to connect, disconnect and reconnect. It is unfortunately easy for a dishonest consumer to be able to surreptitiously tap into a coaxial cable network. It is also far too easy for a dishonest consumer to reconfigure his existing coaxial cable connection system to surreptitiously connect up the cable network to additional receiving devices and to reconfigure his cable net work to eliminate signal traps.

One way that the cable industry has attempted to minimize such tampering is to surround the cable connection points with some sort of shroud which makes it difficult for an individual to get to these connection points. It is usually least expensive to fashion the shroud so that it is threadably attached to the connection jack, either by threads fashioned into the shroud itself or by a nut.

It has been found, however, that such a protecting shroud can be easily broken away from the connection point by twisting the shroud about its longitudinal axis with a pair of pliers or similar pincers-like tool. This is especially a problem where the shroud is constructed of a plastic or light-weight metal material.

In our previously filed application, U.S. patent application Ser. No. 07/911,427, we proposed surrounding two or more coaxial cable connection points with a locking shroud having a plurality of locking shroud chambers, each chamber surrounding one connection point. Such a locking shroud has been found to be highly resistant to tampering by a twisting action with a pincers-like tool. However, it has also been found that the spacing between connection points on "standard" multiple connection coaxial cable equipment tends to vary slightly from manufacturer to manufacturer and, even for one manufacturer, from model to model. Consequently, a locking shroud having multiple locking chambers spaced apart by a fixed distance does not always fit the equipment having the junction points in need of protection.

Accordingly, there is a need for a coaxial cable connection protection system which provides increased tamper resistance, especially, resistance to tampering by being twisted about its longitudinal axis, and which can be easily fitted to most standard coaxial cable connection equipment.

SUMMARY OF THE INVENTION

These needs are met by the coaxial cable connection protection system of the invention. The invention provides a device which is highly tamper resistent and which is highly resistent to degradation from ambient conditions, but which is also easily fitted to standard coaxial cable connection equipment. The device can be used in a system of protection which is inexpensive to construct and which is simple, quick and easy to assemble in the field. The system can be retrofitted onto existing coaxial cable network equipment, using standard coaxial cable connection jacks.

The invention comprises a locking shroud comprising a plurality of chambers, each chamber being attachable to an individual connection jack. Each chamber is connected to at least one other chamber by a flexible web disposed in a curved plane. The fact that the shroud has multiple chambers and is connected to multiple jacks makes it very difficult to break off by any kind of twisting action. The shroud is therefore much more tamper resistant than prior art shrouds. The fact that each chamber is connected to at least one other chamber by a flexible web allows the shroud to be easily fitted over all "standard" multiple jack coaxial cable connection equipment, even those where the spacing of the jacks is slightly non-standard.

In a preferred embodiment of the invention, the shroud is used in a connection protection system invented by two of us (Messrs. McMills and Mattis). In that embodiment of the invention, the locking shroud is part of the system which further comprises a connection jack connector and a swagging shell. The connection jack connector comprises a jack attachment moiety and a cable attachment moiety. The connection jack attachment moiety has a collet structure with a base, a base aperture and a plurality of flared fingers. The cable attachment moiety has an open-ended hollow cylinder which communicates with the aperture and the collet base. The connection jack attachment moiety is attached tightly around the body of the connection jack and the cable attachment moiety is attached to the coaxial cable terminus in such a way that the cable attachment moiety is in electrical contact with the concentric conductor of the cable terminus and in such a way that the central conductor protrudes axially through the collet base aperture, through the connection jack aperture and is in electrical contact with the electrical conductor within the connection jack.

The swagging shell is hollow and open-ended. It comprises a compression moiety and a retraction moiety. The compression moiety is disposed tightly over the flared fingers of the connection jack connector thereby applying hoop stress to the flared fingers so as to urge the flared fingers into tight connection with the threaded body of the connection jack.

The locking shroud is disposed with respect to each connection jack in such a way that the side walls surround each connection jack, connection jack connector and swagging shell.

In one embodiment of the system, the cable connection moiety of the connection jack is a mandrel which is disposed between the central conductor of the cable terminus and the concentric conductor of the cable terminus. In a preferred embodiment, the mandrel has external threads to facilitate its insertion into the cable terminus. In such an embodiment, the braided metal strands of the typical concentric conductor of the cable terminus are most preferably disposed between the exterior surface of the flared fingers and the compression moiety of the swagging shell.

In another embodiment of the invention, the inside diameter of the compression moiety of the swagging shell is larger than the inside diameter of the retraction moiety, and the inside diameter of the retraction moiety is dimensioned to urge the concentric conductor into tight contact with the cable attachment moiety of the connection jack connector.

In another embodiment of the invention, one or more locking shroud liners are nested within the chambers of the locking shroud to provide additional strength and tamper resistance. In a preferred version of this embodiment, a driver cap is threadably attached to internal threads within each locking shroud liner. Each driver cap is dimensioned to apply force to the distal end of the cable attachment moiety of the swagging shell.

The invention also comprises a kit comprising the conductive connection jack connector, the swagging shell and the locking shroud described above.

The invention also comprises a method for protectively connecting a coaxial terminus to a standard connection jack using the kit described above.

DESCRIPTION OF THE DRAWINGS

These and other features, aspects and advantages of the present invention will become understood with reference to the following description, appended claims and accompanying drawings, where:

DETAILED DESCRIPTION

Figure 1:
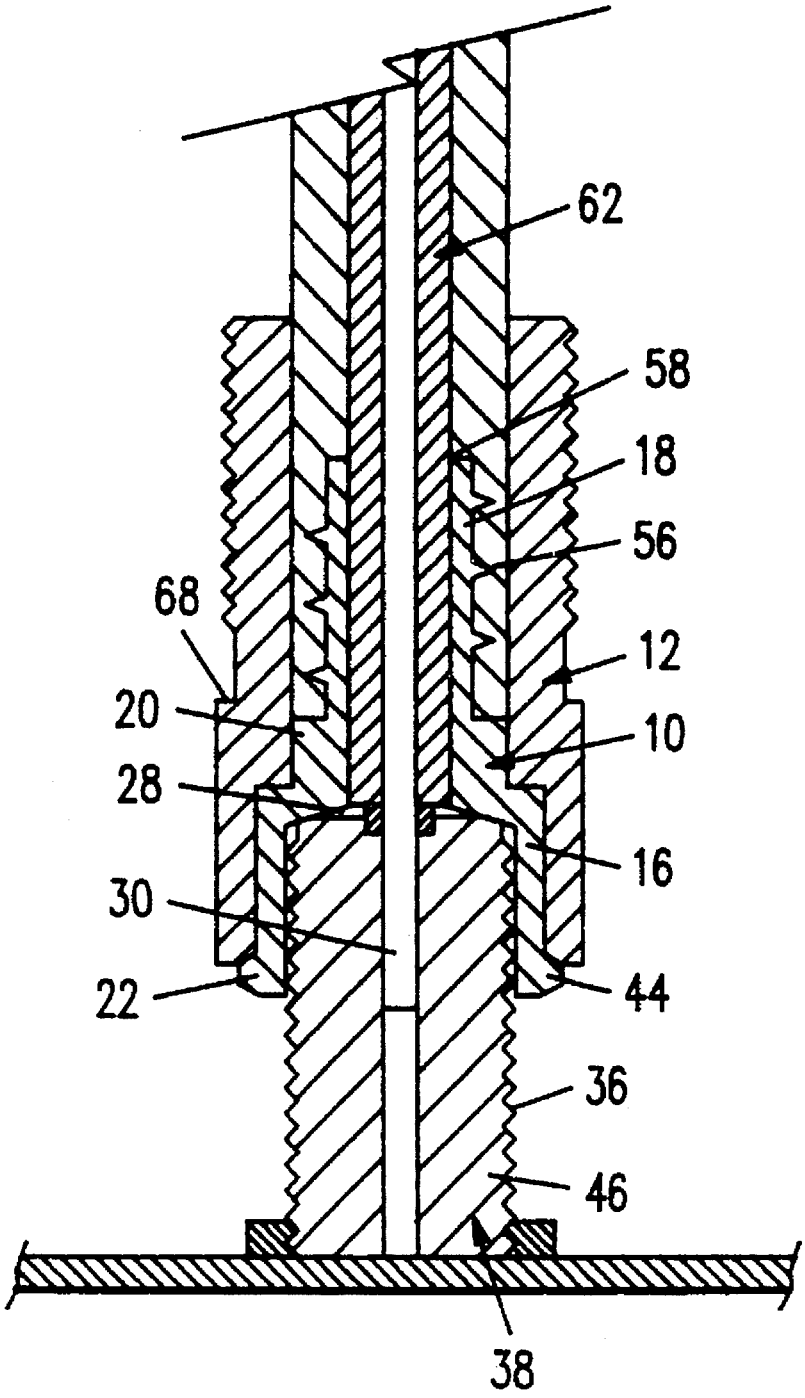
FIG. 1 is a cross-sectional view of a coaxial cable connection protection system useful in the invention.

The invention comprises a locking shroud 14 having multiple locking shroud chambers 80. The locking shroud 14 is attachable to more than one connection jack 38. The invention is shown in FIGS. 2, 3, 4 and 17.

In a preferred embodiment of the invention, the locking shroud 14 is used as part of a connection protection system comprising a connection jack connector 10, a swagging shell 12 and the locking shroud 14.

Figure 10:
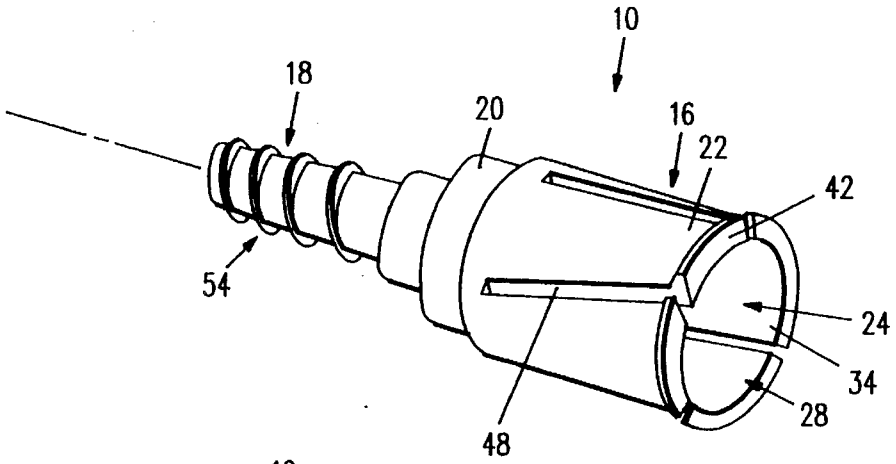
FIG. 10 is a prospective view of a connection jack connector useful in the invention.
Figure 11:
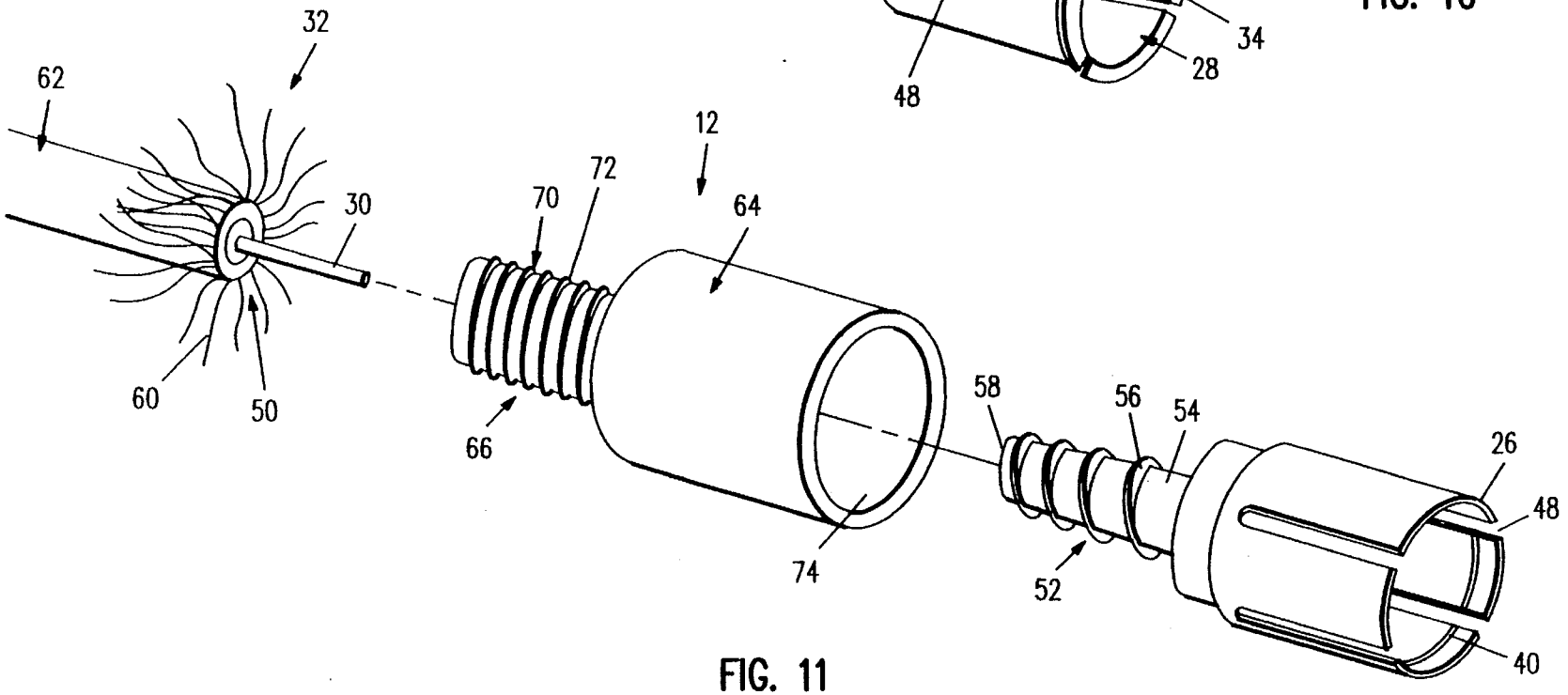
FIG. 11 is a prospective view of an assemblage comprising a connection jack connector and a swagging shell useful in the invention.

As shown in FIGS. 1, 10 and 11, the connection jack connector 10 comprises a connection jack attachment moiety and a cable attachment moiety 18. The connection jack attachment moiety 16 has a collet structure with a collet base 20 and a plurality of flared fingers 22 which extend outwardly from the base 20 to form a collet attachment cup 24 having a peripheral edge 26.

The collet base 20 defines a central aperture 28 dimensioned to allow the central conductor 30 of a coaxial cable terminus 32 to protrude through the collet base 20 into the collet cup 24 without making electrical contact with the connection jack connector structure. A typical circular central aperture 28 has a diameter between about 0.15 and about 0.30 inches.

The fingers 22 define the collet cup 24 and provide an inside cylindrical engagement surface 34 suitable for engaging the outer threaded surface 36 of a connection jack 38. The inside surface 34 of the fingers 22 may be smooth or it may be provided with a shallow-cut helical groove, thread or ridge 40. Preferably, each finger can have a ridge 40 running laterally across the width of each finger 22. The pitch of the ridge 40 is set to correspond with the thread pitch of the jack 38. In embodiments having the ridge 40, a more positive attachment can be achieved between the connection jack connector 10 and the connection jack 38.

Preferably, each finger 22 is formed with a thickened region 44 adjacent to the chamfer 42 and becomes gradually thinned toward its connection with the collet base 20. The inside geometry of the collet cup 24 is generally cylindrical when in an unstressed, uncompressed state. When in such unstressed, uncompressed state, the collet cup 24 defines a slightly curved or frustroconical geometry. This allows the connection jack attachment moiety 16 to be easily slipped over the outside surface 36 of the connection jack body 46.

The collet cup 24 is dimensioned so that, in its unstressed state, it can be easily slipped over the outer surface of a connection jack body 46 but, when hoop stress is applied to the external surface of the fingers 22, the connection jack attachment moiety 16 can be tightly connected around the body 46 of a connection jack 38.

In a preferred embodiment to be used with a jack having an outside diameter of 0.375 inches, the collet structure comprises four fingers 22, each defining a quadrant of a cylinder having an inside diameter between about 0.37 and about 0.38 inches. Each finger is between about 0.2 and about 0.5 inches long. Each finger 22 is separated from an adjacent finger by a longitudinal slot 48 which can be between about 0.01 and about 0.1 inches wide, preferably between about 0.04 and about 0.05 inches wide. The fingers 22 may be formed by cross-sawing across the collet structure at right angles. Alternatively, and preferably for mass production, the fingers 22 are formed by a single machining operation of two parallel saws which move in one direction across the collet structure.

The connection jack connector 10 further comprises a cable attachment moiety 18. The cable attachment moiety 18 is physically attached to the connection jack attachment moiety 16 proximate to the collet base 20. The cable attachment moiety 18 is also adapted to attach to the coaxial cable terminus 32 in such a way that the cable attachment moiety 18 is in electrical contact with the concentric conductor 50 of the cable terminus 32 while the central conductor 30 is caused to protrude axially through the collet base aperture 28 and into the center of the collet cup 24.

The cable attachment moiety 18 can be any of the standard crimp-on varieties commonly known in the industry. The cable attachment moiety 18 can also be one of the several types disclosed in U.S. patent application Ser. No. 07/364,917, now abandoned, which is incorporated herein by reference.

Preferably, however, the cable attachment moiety 18 is a screw mandrel 52 having (1) a cylindrical mandrel element 54 and, (2) a helical knife-blade ridge 56 which forms a screw thread defined on the exterior of the mandrel element 54. The mandrel element 54 is generally cylindrical having an outside diameter chosen for use with the size of the cable outside diameter with which it is to be used. For RG59 cable, the preferred outside diameter of the mandrel element 54 is between about 0.20 and about 0.21 inches. Preferably, the mandrel element 54 is slightly frustroconical for ease of insertion. Also, in a typical embodiment, the portion of the mandrel element 54 distal from the collet base 20 is thinned to provide a sharp rearward opening 58. The helical knife-blade ridge 56 has a height which is between about 0.02 and about 0.06 inches, preferably between 0.038 and 0.042 inches, and is formed as a acutely angled projection extending from the mandrel element 54. In a preferred embodiment, the "threads" which are formed by knife-edge ridge 56 are 60° angle threads and are disposed at about 8 to about 16 threads per inch, preferably between about 11 to about 13 threads per inch.

The helical knife-blade ridge 56 is shaped so as to bite sufficiently into the metal braid 60 which forms the concentric conductor 50 in most coaxial cable. Such a helical knife-blade ridge 56 has also been shown to provide a secure mechanical attachment to the coaxial cable terminus 32 without causing the metallic strands which form the braided concentric conductor 50 to shear or break off. An effective compromise between sharpness and dullness of the knife-blade edge ridge 56 is to make it flat across for about two to three mils. A one mil flat is too sharp and will result in shearing the fine wire braid 60, while an eight-mil radius at the edge has been found to be too dull with resultant slippage of the braid under tension. Ideally, the knife-blade ridge 56 should subject the braid wires to shear stresses without actually resulting in shearing.

The use of a helical knife-blade ridge 56 on the cable attachment moiety 18 of the connection jack connector 10 has been found to be particularly advantageous in order to facilitate easy insulation of the connection jack connector 10 onto the coaxial cable 62, especially at low ambient temperatures.

The connection jack connector 10 is made from an electrically conductive material, usually a metal. Aluminum is a highly preferred such metal because it is light weight, inexpensive and highly conductive. Where the cable attachment moiety 18 comprises a screw mandrel 52 and the cable attachment moiety 18 is made from aluminum, another conductive material, such as a tin alloy, is preferably applied to the exterior of the mandrel element 54 to provide additional lubricity to the exterior of the mandrel element 54 and to facilitate the insertion of the mandrel element 54 into the coaxial cable terminus 32.

The swagging shell 12 has an open-ended hollow tubular shape. The swagging shell 12 has a compression moiety 64 and a retraction moiety 66. The compression moiety 64 is adapted to apply hoop stress to the exterior of the collet fingers 22 on the connection jack connector 10 and the retraction moiety 66 is adapted to interface with one or more tools adapted to drive the swagging shell 12 over the collet fingers 22 and/or, alternatively, to retract the compression moiety 64 off of, and away from, the collet fingers 22.

The compression moiety 64 is generally cylindrical and is dimensioned to be slidable over the collet fingers 22 in such a way as to impart considerable hoop stress to the collet fingers 22, thereby causing the collet fingers 22 to tightly grip the exterior surface 36 of the connection jack body 46. For a standard jack having an outside diameter of about 0.375 inches, the inside diameter of the compression moiety 64 is typically between about 0.40 and about 0.42 inches, preferably between about 0.410 and 0.415 inches.

The retraction moiety 66 of the swagging cylinder 12 is also typically cylindrical. It is attached to the compression moiety 64 in such a way that the longitudinal axes of the compression moiety 64 and the retraction moiety 66 are coaxial. The inside diameter of the compression moiety 64 is dimensioned to allow the retraction moiety 66 to slip freely along the outside of the coaxial cable 62. In a preferred embodiment, the outside diameter of the retraction moiety 66 is dimensioned to be slightly smaller than the outside diameter of the compression moiety 64 so that an annular shoulder 68 is formed at the interface of the retraction moiety 66 and the compression moiety 64. In a typical embodiment, the annular shoulder 68 is between about 0.10 and about 0.20 inches in width. Such annular shoulder 68 provides a surface against which an axial force can be applied so as to urge the swagging shell 12 over the collet fingers 22.

In another preferred embodiment, the exterior surface 70 of the retraction moiety 66 is provided with indentations, ridges or other structure capable of providing a surface against which a force can be applied to the swagging shell 12 to urge the swagging shell 12 off of the collet fingers 22. In a most preferred embodiment, such structure is provided by external screw threads 72.

The swagging shell 12 is made from a rigid material capable of withstanding the pressures and wear and tear resulting from its interaction with the collet fingers 22 and with various driving and retraction tools. Typically, the swagging shell 12 is made from a metal, such as a brass, an aluminum or a steel.

Where the connection jack connector 10 comprises a mandrel element 54 which is physically inserted into the coaxial cable terminus 32 (such as the screw mandrel 52 described above), the swagging shell 12 is preferably constructed so that the internal diameter of the retraction moiety 66 is smaller than the internal diameter of the compression moiety 64, and the interior surface 74 of the swagging shell 12 at the interface between the retraction moiety 66 and the compression moiety 64 is beveled. Also, the internal diameter of the retraction moiety 66 can be dimensioned so as to apply a compressive force to the exterior of the cable terminus 52 in the region of the terminus 52 wherein has been inserted a connection jack connector 10 having a mandrel-type connection jack attachment moiety 18. In such an embodiment, the inside diameter of the retraction moiety 66 is dimensioned to be about the same or only slightly larger than the outside diameter of the cable terminus 32 after insertion of the mandrel element 54. Such a swagging shell 12 can be used to apply compressive force to the exterior of a coaxial cable terminus 52 having inserted therein a cable attachment moiety 18 comprising a mandrel element 54. Such compressive force is effective in securing and maintaining a positive electrical connection to the concentric conductor 30 of the coaxial cable 62 and the mandrel element 54 of the connection jack connector cable attachment moiety 18.

In a preferred method of installing a connection jack connector 10 having a mandrel element 54 to the coaxial cable terminus 32, strands of the metal braid 60 which form the concentric conductor 50, are disposed around the exterior of the collet fingers 22 and are held fast against the fingers 22 by the compression moiety 16 of the swagging shell 12. This installation method has been found to provide a superior electrical connection between the cable attachment moiety 18 of the connection jack connector 10 and the concentric conductor 50, a connection which will not fail even after numerous temperature cycles.

Figure 2:
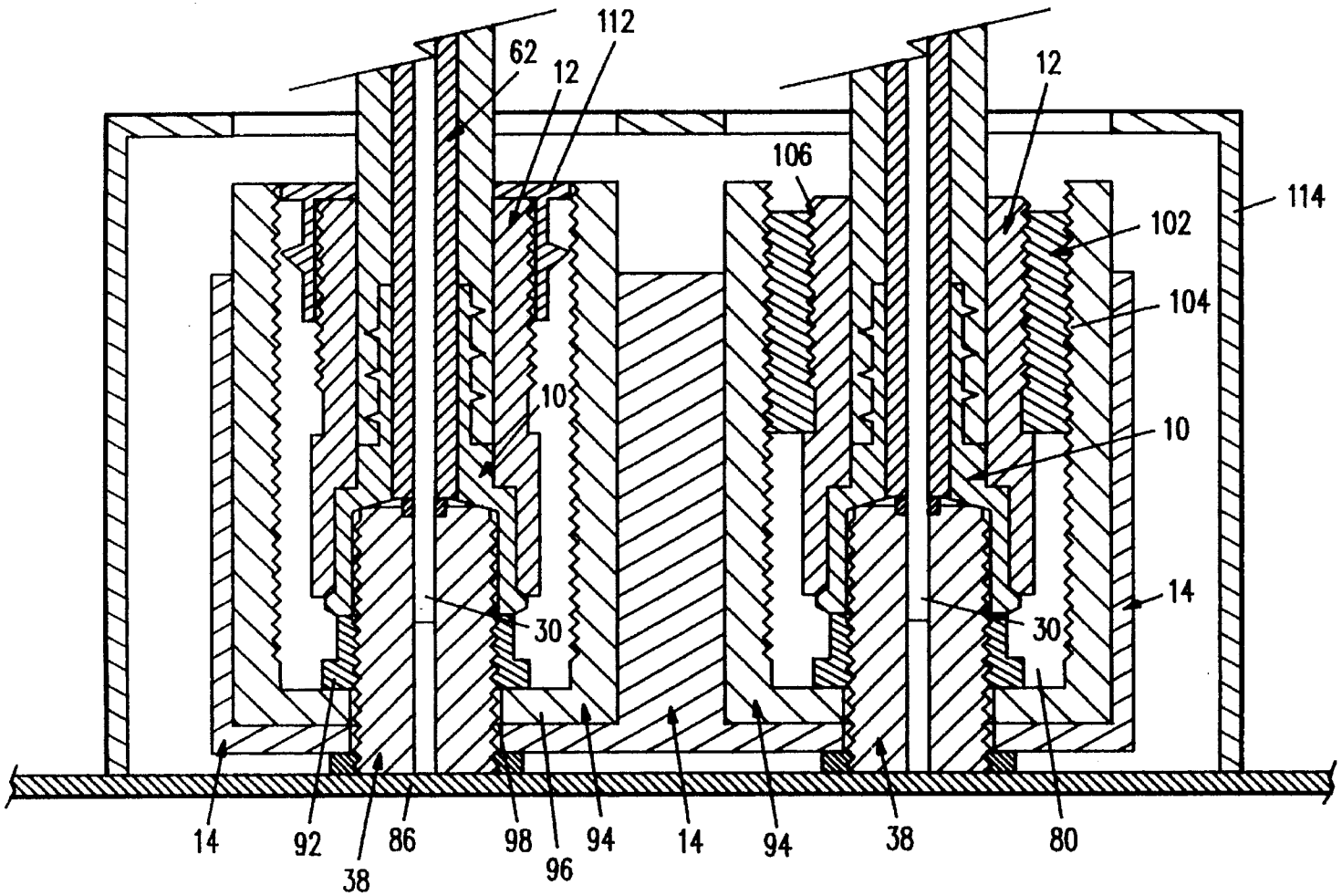
FIG. 2 is a cross-sectional view of a coaxial cable connection protection system having features of the invention.
Figure 3:
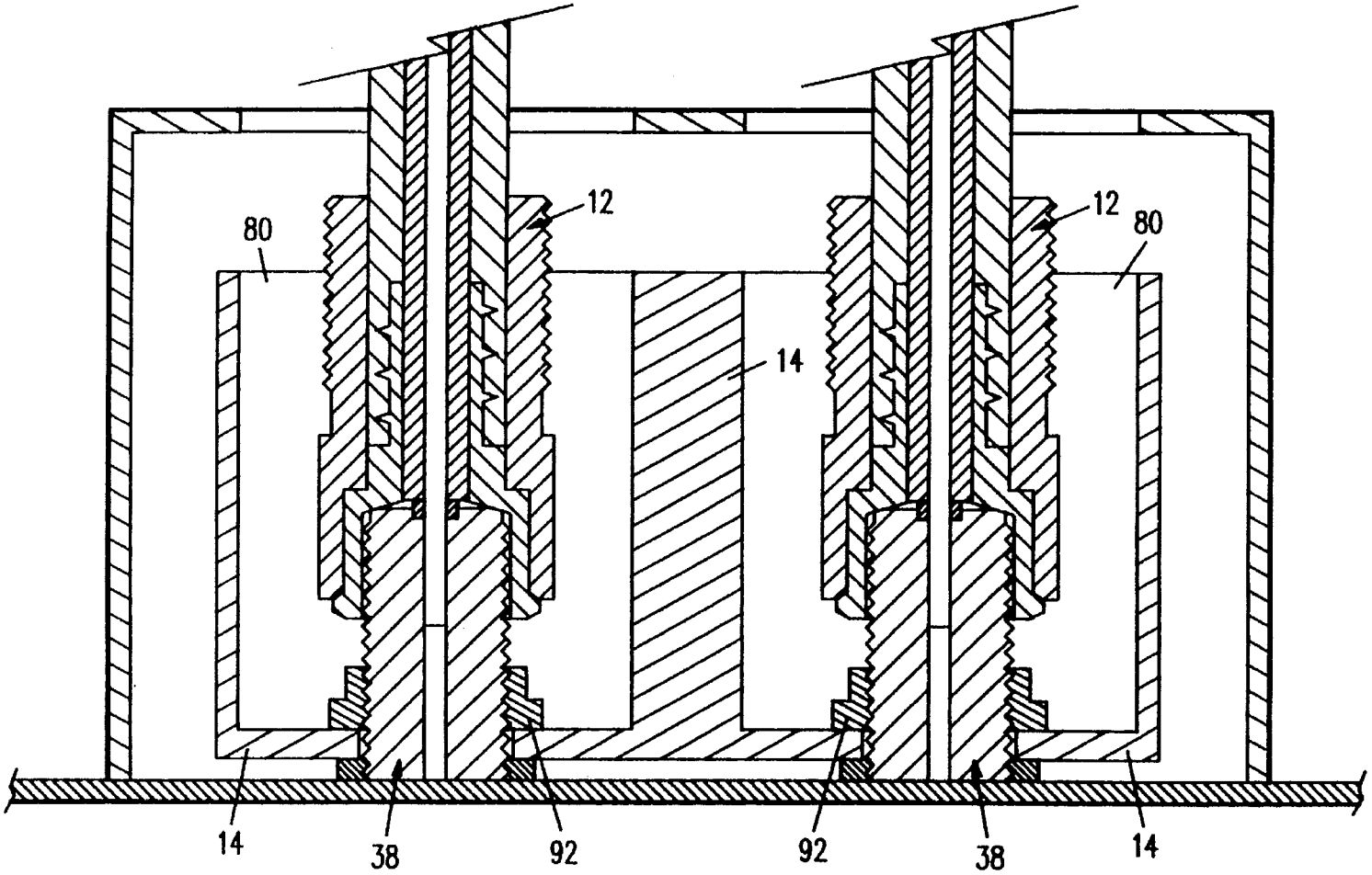
FIG. 3 is a cross-sectional view of a second embodiment of a coaxial cable connection protection system having features of the invention.

FIGS. 2 and 11 illustrate how the swagging shell 12 compresses the connection jack connector 10 to form a tight connection with the cable terminus 32 and the connection jack 38.

The locking shroud 14 is disposed over a plurality of connections with connection jacks 38. The locking shroud 14 is an elongated hollow structure having elongated sidewalls 78 which define a plurality of locking shroud chambers 80. The locking shroud chambers 80 each have an open end 82 to allow for insertion into the chamber 80 of the terminus of a coaxial cable 52.

Figure 17:
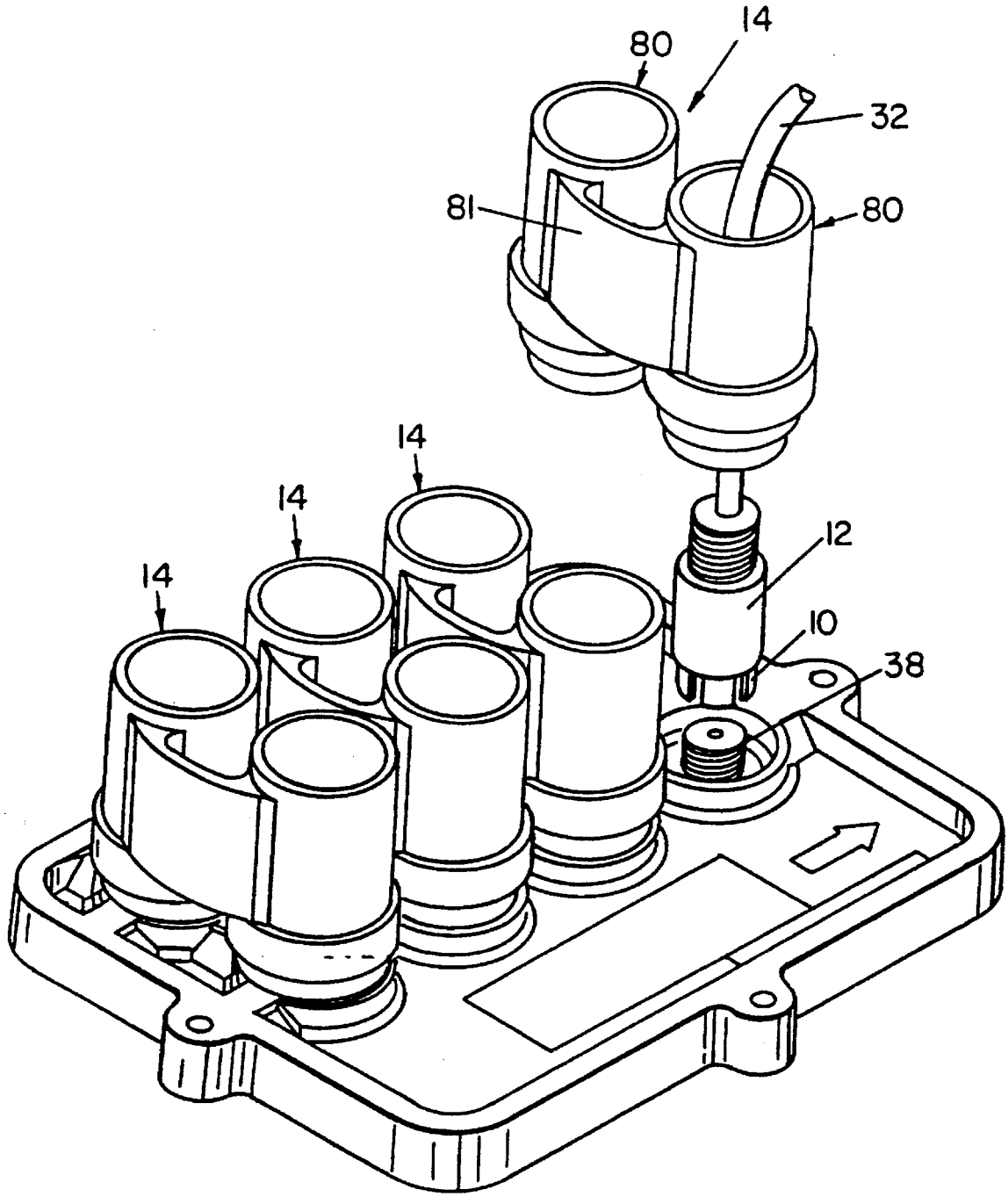
FIG. 17 is a perspective of an a plurality of locking shrouds having the flexible web features of the invention.

Referring to FIG. 17, each locking shroud chamber 80 is connected to one other locking shroud chamber 80 by a flexible web 81 disposed in a curved plane. Such web 81 allows the spacing between the locking shroud chambers 80 to be slightly adjusted by flexing the web 81.

Typically, the flexible web is made of a resilient, semi-rigid material such as a semi-rigid plastic. Other materials can be used as well, so long as the web retains enough flexibility to allow the spacing between the shrouds to be sufficiently adjusted, and so long as the web retains sufficient strength to resist tampering by someone applying a twisting moment.

In the embodiments shown in the drawings, the thickness of the web is relatively uniform. Where the web material is a semi-rigid plastic, such as nylon or polycarbonate, the thickness of the web is typically between about 0.04 inches and about 0.14 inches, preferably between about 0.05 inches and about 0.07 inches. The web need not, however, have a uniform thickness. The web can have a central "thin" portion to give it additional flexibility.

The curvature of the web will also depend on the degree of flexibility required and the material used to form the web. In a typical embodiment where the web is made from a semi-rigid plastic, the curvature of the web can be between about 50 degrees and about 80 degrees, preferably between about 55 degrees and about 73 degrees.

In a typical embodiment, the curvature of the web, the thickness of the web and the material of the web is chosen such that the spacing between the locking shroud chambers can be easily changed by ±20% without special tools and without damaging the web. Preferably, the spacing between the locking shroud chambers can be easily changed by ±25% without special tools and without damaging the web.

Typically, each chamber 80 is relatively long and relatively narrow so as to inhibit the ability of an individual to project his or her fingers or an ordinary tool through the open end of the chamber 80 to tamper with the connection between the jack 38 and the jack connector 10. In a preferred embodiment, each locking shroud chamber 80 is cylindrical and has a diameter only slightly larger than the outer diameter of the swagging shell 12. The amount of annular space between each locking shroud 14 and the swagging shell 12 can be sufficient to insert a retraction tool or it may be less. In a typical embodiment, the difference between the inside diameter of each locking shroud chamber 80 and the outside diameter of the swagging shell 12 is between about 0.005 and about 0.2 inches.

The locking shroud 14 should preferably be constructed of a tough, tamper-resistent material, such as a metal or a strong plastic.

The locking shroud 14 is adapted to be attachable to a plurality of connection jacks 38. In a typical embodiment, the locking shroud 14 has a plurality of transverse end walls 88 each of which define a central aperture 90 dimensioned to accept therethrough a connection jack 38. In such an embodiment, the locking shroud 14 can be secured at the base of the jack 38 by a nut 92 threadably attached over the jack 38 so as to firmly bind the end wall 88 of the locking shroud 14 between the nut 92 and the tap face 86.

Figure 4:
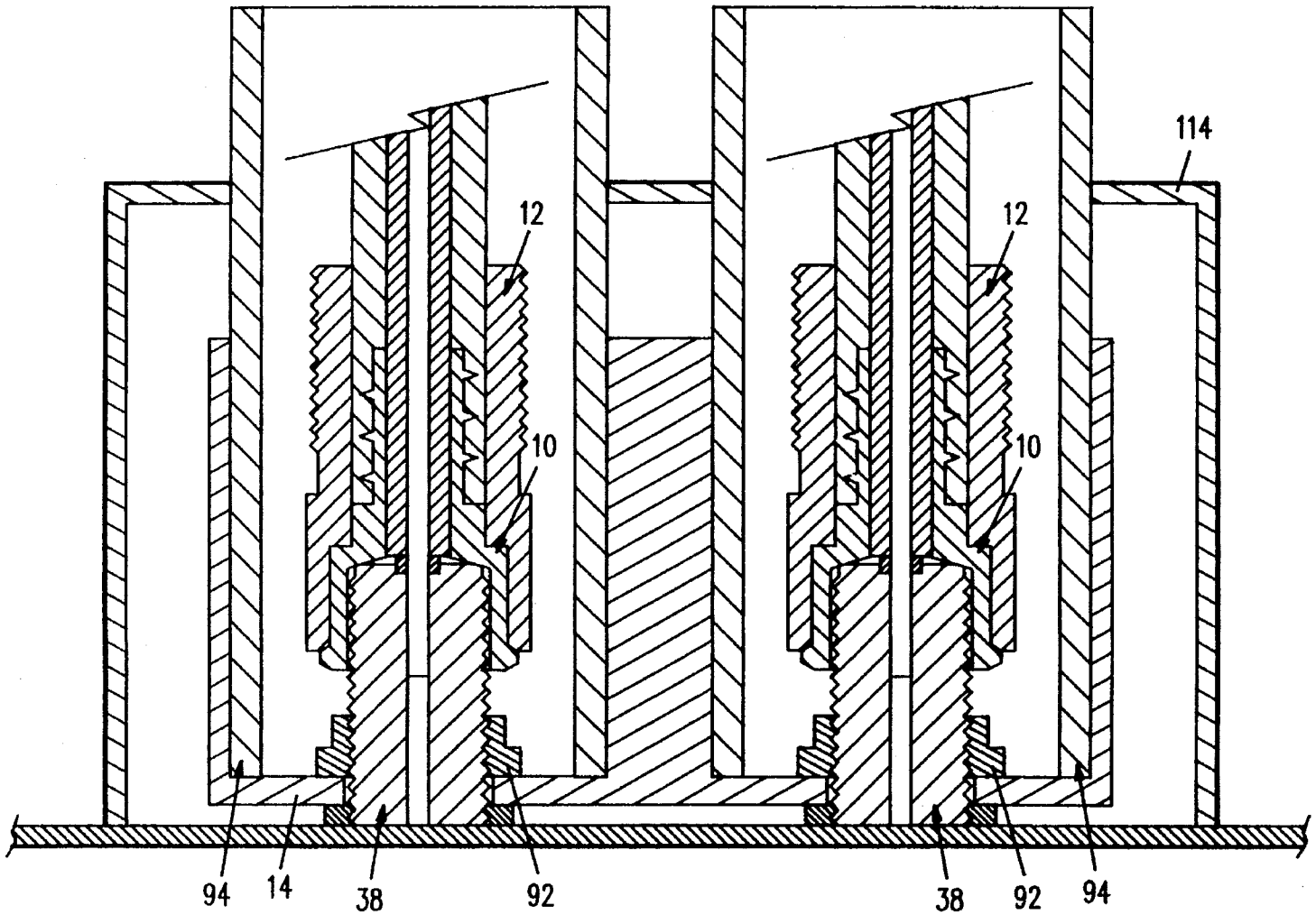
FIG. 4 is a cross-sectional view of a third embodiment of a coaxial cable connection protection system having features of the invention.

As shown in FIG. 4, a locking shroud liner 94 can be disposed within each locking shroud chamber 80 to provide additional strength and tamper resistance. For example, in embodiments of the invention wherein the locking shroud 14 is manufactured from a plastic, a metallic locking shroud liner 94 can be disposed within one or more of the locking shroud chambers 80. Each locking shroud liner 94 can be attached within the locking shroud chambers 80 in any number of ways. In one embodiment, each locking shroud liner 94 comprises an end wall 96 having a central aperture 98 dimensioned to slip over the connection jack 38, and a nut 92 is provided to threadably attach over the jack 38 to thereby secure the locking shroud liner 94 at the base of the jack 38. In another embodiment, the locking shroud liner 94 has an end wall 96 with a central aperture 98 which is internally threaded and dimensioned to threadably connect to the connection jack 38. This embodiment is illustrated in FIG. 2 (right side). In such an embodiment, it is preferable to provide the locking shroud liner 94 with indentations or ridges capable of engaging a tool or other means of applying a rotational force to the liner 94 so as to be able to rotate the liner 94 off of the jack 38. Preferably, the clearance between the locking shroud liner 94 and the locking shroud chamber 80 is between about 0.005 and about 0.01 inches.

As shown in FIG. 2, in one embodiment of the invention, the swagging shell 12 is driven onto the collet fingers and the locking shroud chamber 80 is sealed by use of a driver cap 102. The driver cap 102 is a small cylindrical section, typically between about 0.2 and about 0.3 inches long, and having external threads 104 and a central aperture 106. The central aperture 106 is dimensioned to freely slide along the exterior of coaxial cable 62. Typical central aperture inside diameters are between about 0.24 and about 0.41 inches. The driver cap 102 is used with embodiments of the invention having a cylindrical locking shroud liner 94. The locking shroud liner 94 is provided with internal threads 108, and the outside diameter of the driving cap 102 is dimensioned to threadably attach to those threads 108. The surface 110 provided by the annular thickness of the driver cap 102 is dimensioned to cooperate with an opposing surface on the swagging shell 12 so that the driver cap 102 can be used to drive the swagging shell 12 onto the collet fingers 22 by threading the driver cap 102 into the locking shroud 14 (or locking shroud liner 94). To facilitate rotation of the driver cap 102, the driver cap can be provided with indentations 111 or ridges which will cooperate with a tool or other force-imparting means for rotating the driver cap 102.

As shown in FIG. 2, a dust cover 112 can be used to seal the open end 82 of each locking shroud chamber 80 from ambient air. A typical dust cover 112 will be constructed of a light plastic material and be dimensioned to be received, and frictionally retained, within the open end 82 of the locking shroud chamber 80. In embodiments employing a driver cap 102, a dust cover 112 may be dimensioned to be received and retained within the central aperture 106 of the driver cap 102.

Figure 12:
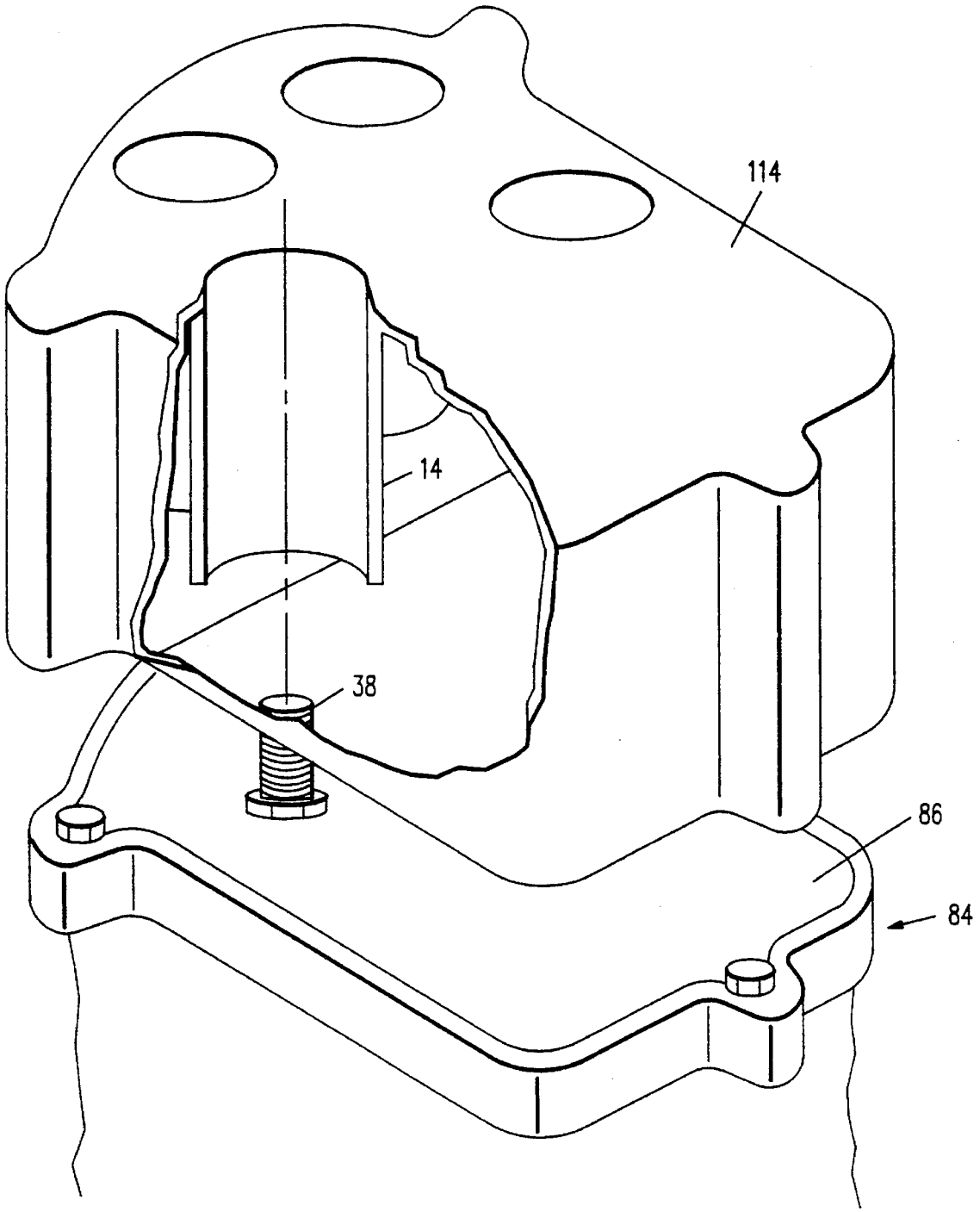
FIG. 12 is a prospective view in partial cross-section of a locking shroud and a locking shroud cover useful in the invention.

As illustrated in FIGS. 2, 3, 4 and 12, a locking shroud cover 114 can be used to encapsulate the locking shroud 14. A locking shroud cover 114 can be effectively used, for example, to cover the entire area of a tap face 86. A locking shroud cover 114 provides additional protection against tampering and can also provide an additional sealing function with respect to ambient air. It should be noted that in FIG. 12, the open of the locking shrouds 14 are shown flush with the openings in the top wall of the locking shroud cover 114. In a typical embodiment, this is the usual disposition of the open ends 82 of the locking shroud 14 vis-a-vis the top wall of the locking shroud cover 114. FIG. 12 should not be interpreted, however, as suggesting that the upper ends 82 of the locking shroud 14 are physically attached to the top wall of the locking shroud cover 114. This is not the case in a typical embodiment.

The invention also is a kit usable in the methods of assembly described above to provide protection from tampering and from ambient air degradation. Such kit comprises the connection jack connector 10, the swagging shell 12 and the locking shroud 14 described above. Such a kit can also comprise one or more of the following devices described above: a locking shroud liner 94, a driver cap 102, a nut 92, a locking shroud cover 114, and one or more of the tools described below.

Figure 9:
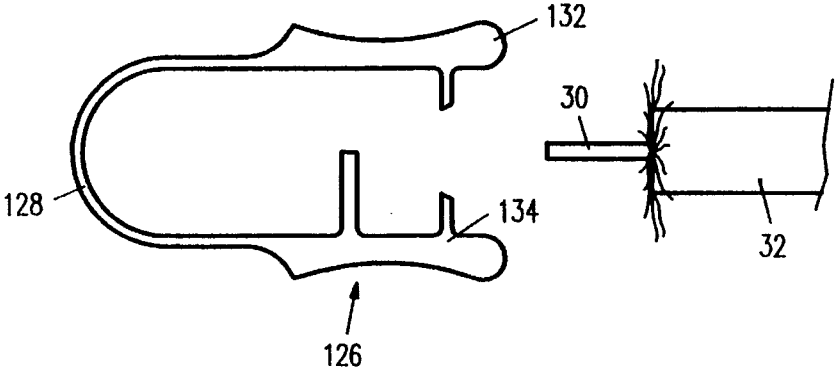
FIG. 9 is a side view of a cable terminus preparation tool useful in the invention.
Figure 13:
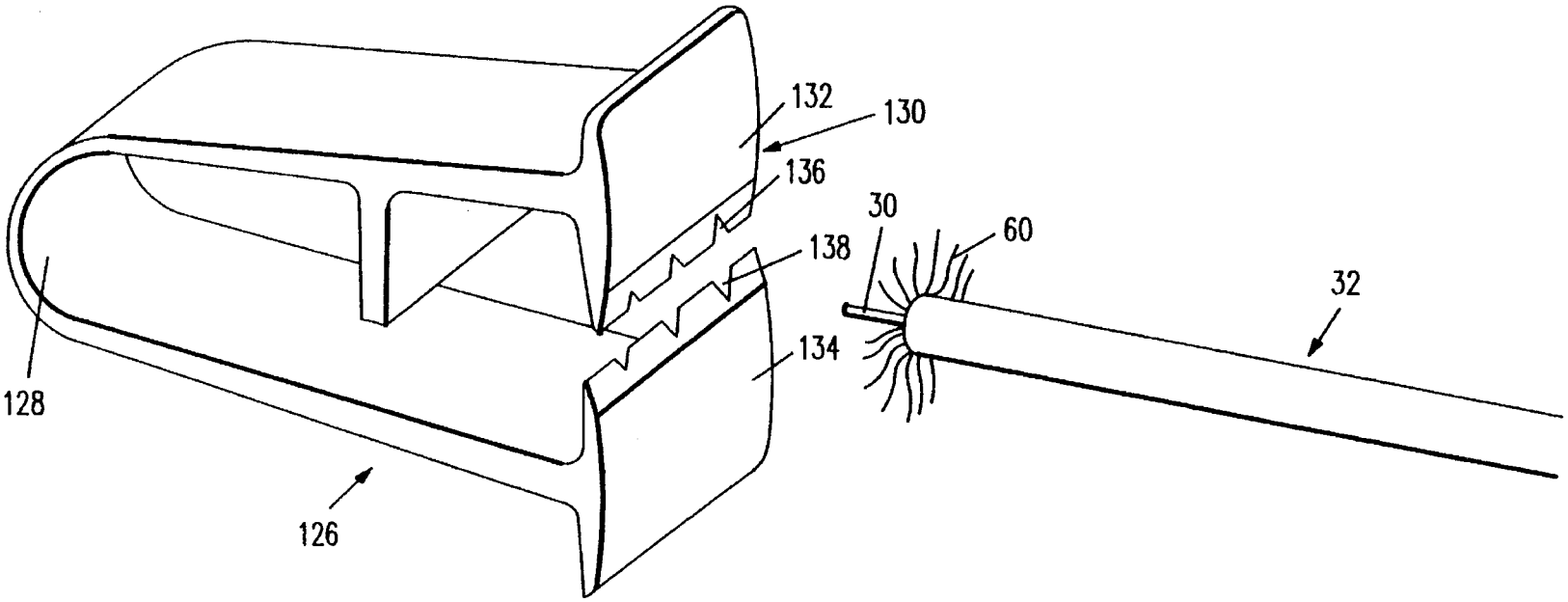
FIG. 13 is a prospective view of a tool for preparing the cable terminus for use in the invention.

There are several tools which have been found to be useful in the invention. A first tool is the coaxial cable preparation tool 126 shown in FIGS. 9 and 13. The tool 126 can be made as a one-piece unit having a live hinge 128. The tool 126 has a jaw structure 130 comprising a pair of opposing jaw moieties 132 and 134, respectively. The two jaw moieties 132 and 134 are adapted with circular blade structures 136 and 138, respectively, which cooperate with one another to provide a circular blade 140 capable of making a circular incision about the periphery of a tubular structure such as a coaxial cable terminus 32. In the embodiment shown in FIG. 13, three such circular blade 140 are shown, each having different dimensions for use with differing sizes of coaxial cable 62. In operation, the terminus 32 of a run of coaxial cable 62 is placed between the appropriate pair of blade structures 136 and 138 so that the terminus 32 extends into the tool 126 beyond the jaw structure 130 a distance of between about 0.2 inches and about 0.4 inches. The opposing jaw moieties 132 and 134 are closed so as to cause the blade structure 136 and 138 to contact the exterior of the cable terminus 32. Thereafter, by rotating the tool 126 back and forth, an individual can quickly and easily expose the forward-most 0.2–0.4 inches of the coaxial cable central conductor 30. This prepares the cable terminus 32 for attachment by the connection jack connector 10. Where the connection jack connector 10 comprises a screw mandrel 52, the central conductor 30 is then protruded into the back end of the mandrel element 54 with the mandrel rear opening 58 being positioned concentrically around the central conductor 30. Thereafter, the mandrel element 54 is rotated clockwise so as to cause the mandrel element 54 to threadably be inserted into the terminus 32 of the cable 62 where it makes positive electrical connection with the concentric conductor 50.

Figure 7:
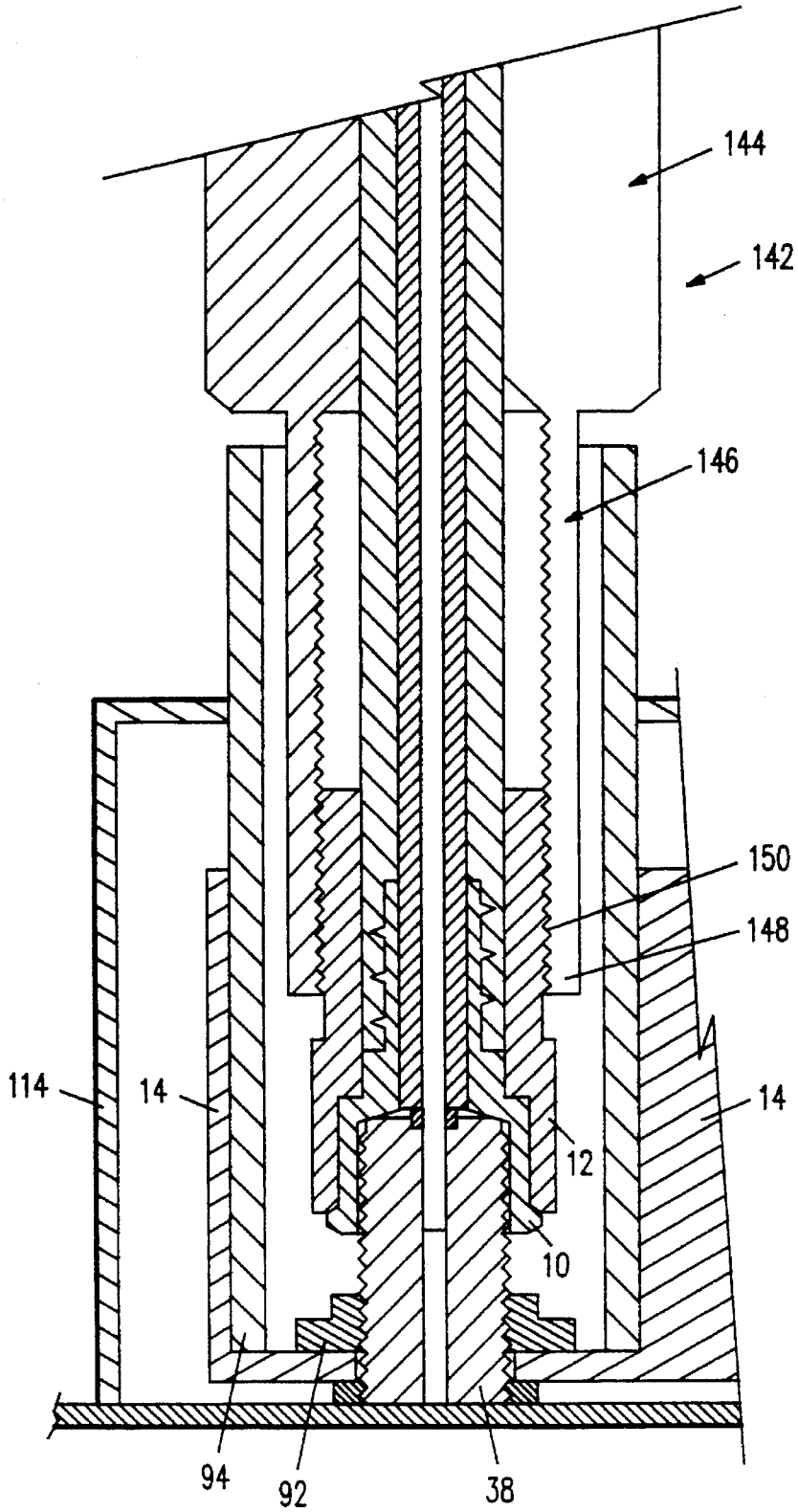
FIG. 7 is a cross-sectional view of a coaxial cable connection protection system having features of the invention showing the use of a second embodiment of a retraction tool useful in the invention.
Figure 14:
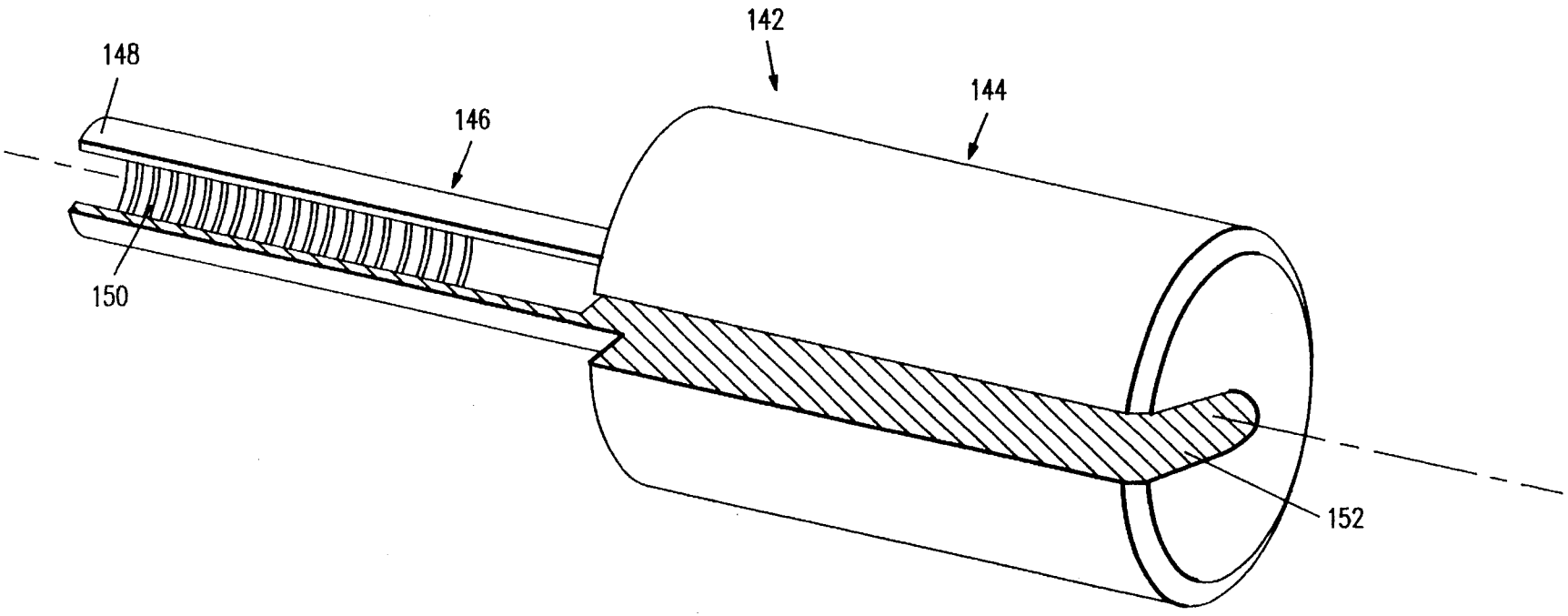
FIG. 14 is a prospective view in partial cross-section of a retraction tool useful in the invention.

Another tool useful in the invention is a retraction tool 142 shown in FIGS. 7 and 14. The retraction tool 142 is used to retract a swagging shell 12 away from the collet fingers 22 on a connection jack connector 38. The retraction tool 142 comprises a body 144 having a central axis, and a hollow, internally threaded retraction cylinder 146 which is attached to the body 144. The retraction cylinder 146 has an outside diameter dimensioned to allow the retraction cylinder to slide freely within the locking shroud chamber 80. Typical outside diameters are between about 0.45 and about 0.55 inches. The retraction cylinder 146 is long enough to cooperate with the retraction moiety 66 of a swagging shell 12 disposed within each locking shroud chamber 80. The distal end 148 of the retraction cylinder 146 is provided with indentations or ridges adapted to attach to the retraction moiety 66 of the swagging shell 12. As shown in FIGS. 7 and 14, such attachment means in a preferred embodiment of the invention is provided by internal threads 150 which are dimensioned to threadably attach to the like threads 72 on the exterior surface 70 of the retraction moiety 66.

Both the body 144 and the retraction cylinder 146 define a continuous external groove 152 which encompasses the central axis of the body and the longitudinal access of the retraction cylinder. The groove 152 is dimensioned to allow the retraction tool 142 to freely slide along the exterior of a length of coaxial cable 62. In a typical embodiment, the width of the groove is between about 0.40 and about 0.42 inches. In operation, the retraction cylinder 146 of the retraction tool 142 is extended through the open end 82 of a locking shroud chamber 80. It is then attached to the retraction moiety 66 of the swagging shell 12. Thereafter, the body 144 of the retraction tool 142 is pulled away from the locking shroud chamber 80, thereby retracting the swagging shell 12 from off of the collet fingers 22.

Figure 5:
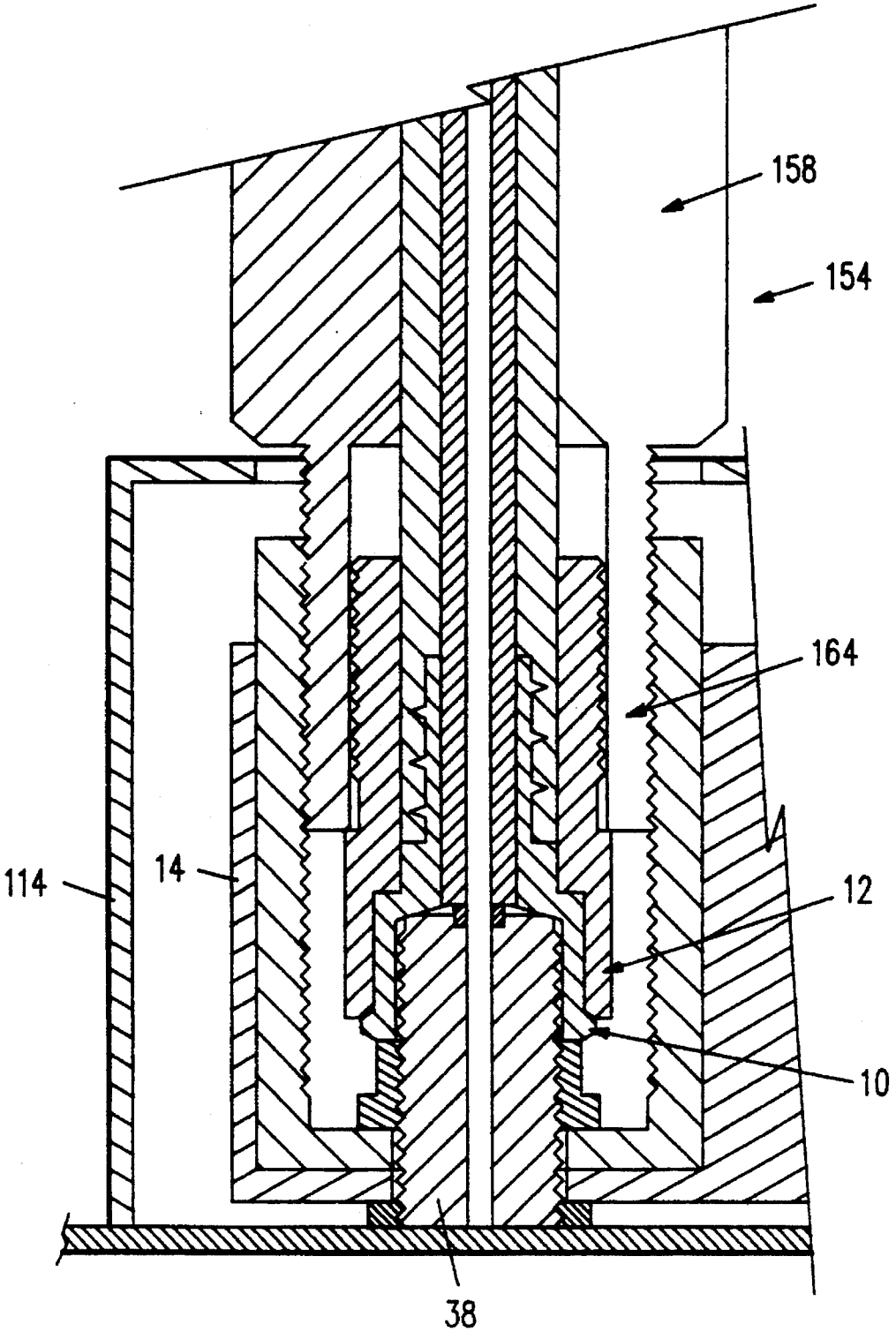
FIG. 5 is a cross-sectional view of a coaxial cable connection protection system having features of the invention showing the use of a driving tool useful in the invention.
Figure 6:
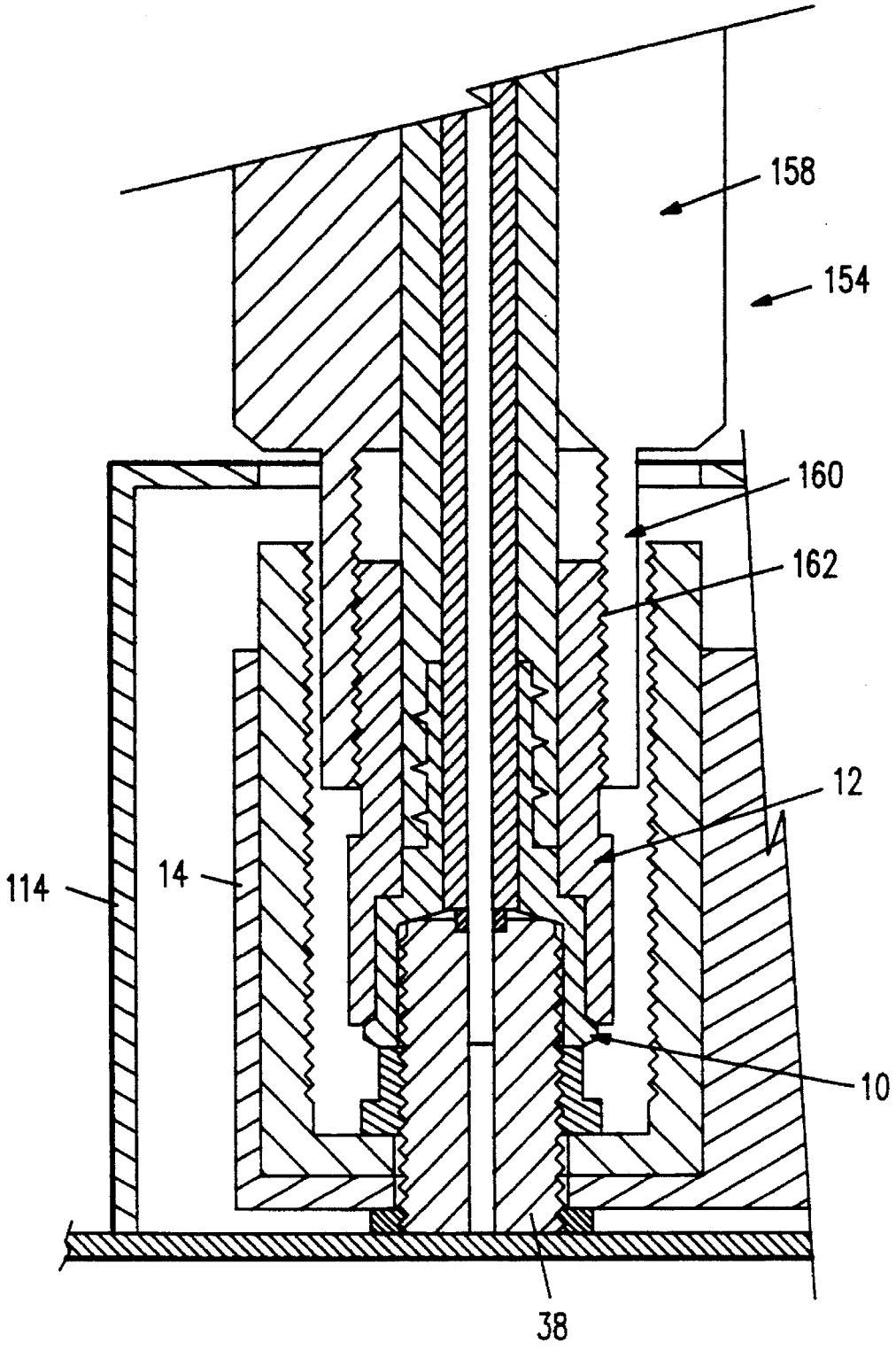
FIG. 6 is a cross-sectional view of a coaxial cable connection protection system having features of the invention showing the use of a retraction tool useful in the invention.
Figure 15:
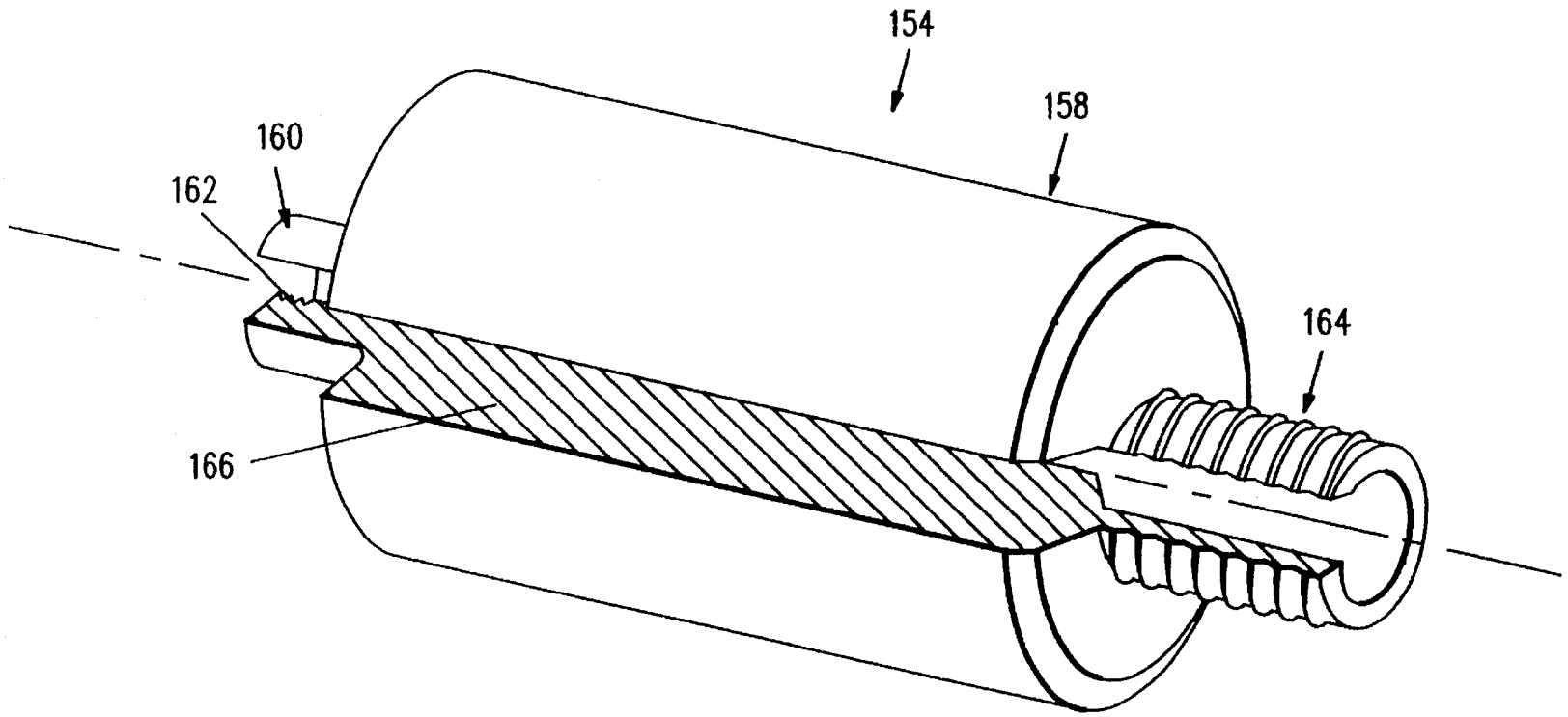
FIG. 15 is a prospective view in partial cross-section of a retraction/driving tool useful in the invention.

Another tool useful in the invention is shown as retraction/driver tool 154 in FIGS. 5, 6 and 15. As shown in detail in FIG. 6, the retraction/driver tool 154, like the retraction tool 142, has a body 158 with a central axis and a hollow, internally threaded retraction cylinder 160 attached to one end of the body 158. Like the retraction cylinder 146 on the retraction tool 142, the retraction cylinder 160 for the retraction/driver tool 154 has an outside diameter dimensioned to allow the retraction cylinder 160 to slide freely within each shroud chamber 80 and has a length and an inside diameter dimensioned to attach to the exterior of the swagging shell 12, such as by threadable attachment 162. The retraction cylinder 160 has a longitudinal axis which is coaxial with the central axis of the body 158.

As shown in detail on FIG. 5, the retraction/driver tool 154 also has a hollow, externally threaded driving cylinder 164 which is attached to the side of the body 158 opposite to the side whereupon is attached the retraction cylinder 160. The driving cylinder 164 has an inside diameter larger than the outside diameter of the retraction moiety 66 of the swagging shell 12 but smaller than the outside diameter of the compression moiety 64. The driving cylinder 164 also has an outside diameter dimensioned to threadably engage internal threads 108 disposed in a locking shroud liner 94. The driving cylinder 164 has a longitudinal axis which is coaxial with the central axis of the body 158 and with the longitudinal axis of the retraction cylinder 160.

Like in the retraction tool 142, the body 158 and cylinders 160 and 164 of the retraction/driver tool 164 define a continuous external groove 166 which encompasses the central axis of the body 158 and the longitudinal axes of the retraction and driving cylinders 160 and 164 respectively. The groove 166 is dimensioned to allow the retraction/driving tool 154 to freely slide along the exterior of a length of coaxial cable 62. In a typical embodiment, the width of the groove 166 is between about 0.40 and about 0.42 inches. In operation, the retraction cylinder 160 is used in a manner comparable to the manner in which the retraction cylinder 146 is used in the retraction tool 142. The driver cylinder 164 of the retraction/driver tool 154 can be used to urge the compression moiety 64 of the swagging shell 12 over the collet fingers 22. The driving cylinder 164 is threadably rotated into the locking shroud chamber 80 until it contacts the annular surface between the compression and retraction moieties of the swagging shell 64 and 66 respectively. Thereafter, by additional rotation of the driving cylinder 154, the driving cylinder 154 applies axial force against the swagging cylinder 12 so as to urge the compression moiety 64 of the swagging cylinder 12 over the collet fingers 32.

Figure 8:
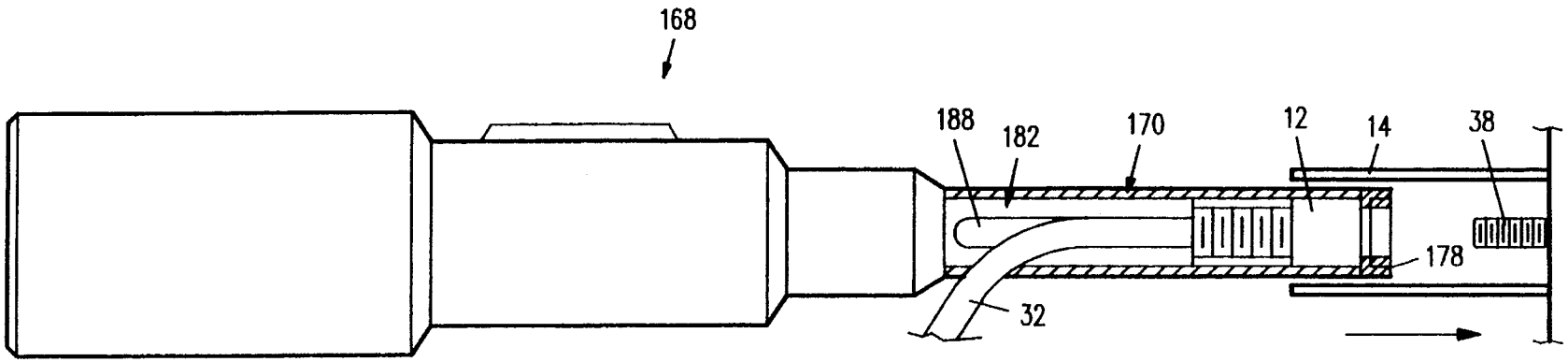
FIG. 8 is a side view in partial cross-section of a motor driven tool for assembling a coaxial cable connection protection system useful in the invention.
Figure 16:
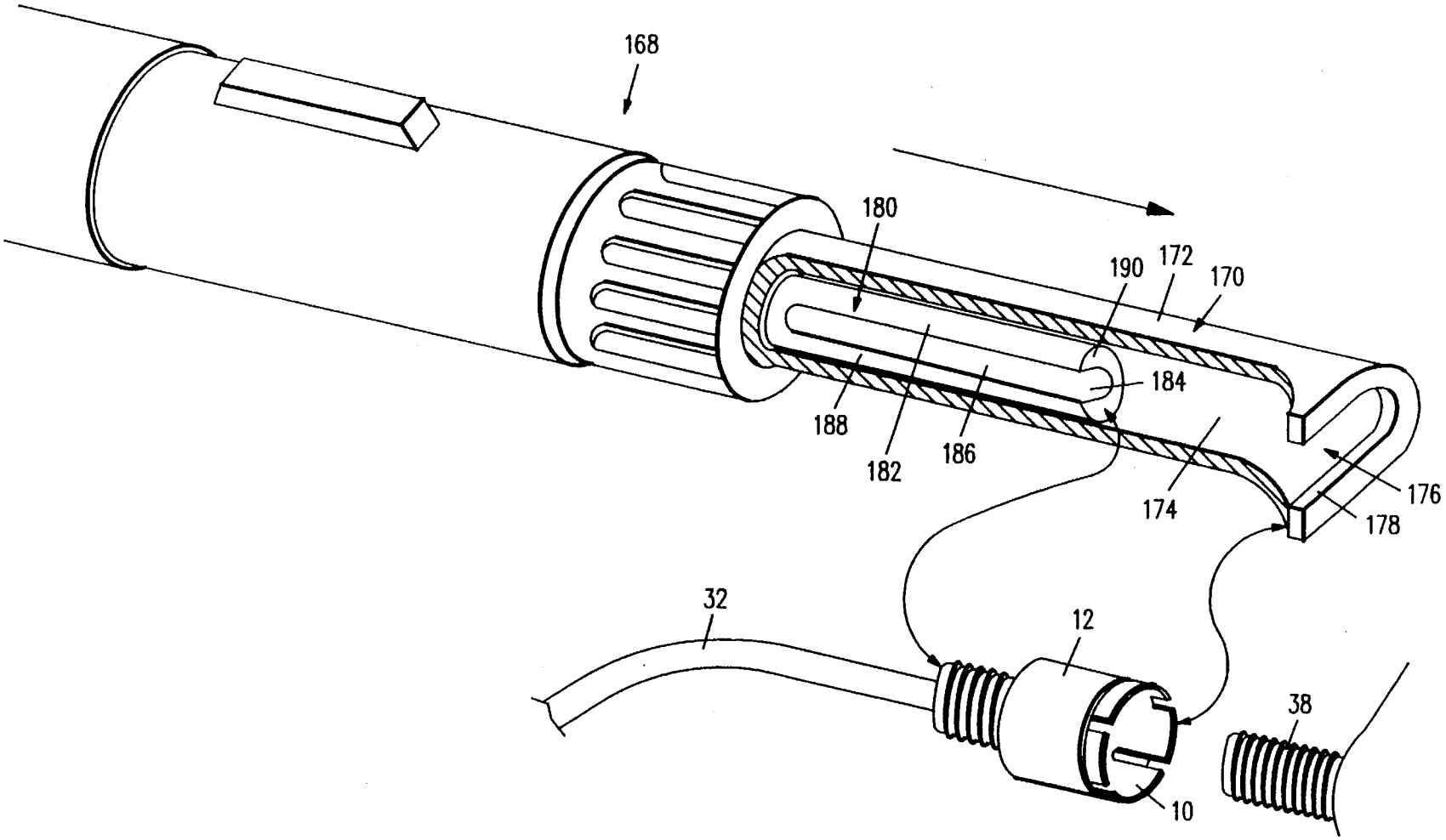
FIG. 16 is a prospective view in partial cross-section of a motor driven tool useful in the invention.

FIGS. 8 and 16 show a motor driven tool 168 useful in the invention. The motor driven tool 168 has a first member 170 which has elongated sides 172 which define a first elongated chamber 174 with an open end 176. The first elongated member 170 is slit along its side in such a way that a length of coaxial cable 62 can be received within the first elongated chamber 170. The open end of the first elongated member 176 has an internal flange 178 dimensioned to contact the peripheral edge 26 of the collet cup portion 24 of a connection jack connector 10.

The motor driven tool 168 further comprises a second member 180, also having elongated sides 182, and an open end 184. The elongated sides 182 of the second member 180 define a second elongated chamber 186 having a slit opening 188 along the side which is dimensioned to accept a section of coaxial cable 62 into the second elongated chamber 186. The open end 184 of the second elongated member 180 has an internal flange 190 dimension to contact the peripheral edge of the retraction moiety 66 of the swagging shell 12. The second member 180 is disposed within the first member 170 in such a way that the open end 184 of the second member 180 is spaced apart from the open end 176 of the first member 170 by a distance greater than the combined length of the connection jack attachment moiety 18 and the swagging shell 12 (typically between about 0.6 and about 0.7 inches).

The motor driven tool 168 further comprises means for urging the open end 184 of the second member 180 towards the open end 176 of the first member 170. Such means can be provided, as suggested in FIGS. 8 and 16, by a battery-operated screwdriver-like engine wherein the rotational energy normally imparted to a screwdriver shaft is translated by appropriate gearing to an axial force which can be imparted to the second elongated member 180.

In operation, each locking shroud chamber 80 is positioned over a corresponding connection jack 38. If the spacing of the connection jacks 38 do not precisely match the spacings between the locking chambers 80, the web 81 is flexed to alter the spacing between the locking chambers 80. After the locking shroud chambers 80 are properly disposed around the connection jacks 38, the first and second members 170 and 180, respectively, are thrust into each of the locking shroud chamber 80 and are positioned so that the open end 176 of the first elongated member 170 is in contact with the peripheral edge 26 of the collet cup 24 of the connection jack connector 10 and so that the open end 184 of the second elongated member 180 is behind the peripheral edge of the retraction moiety 68 of the swagging shell 12. Thereafter, the second elongated member 180 is caused to move within the first elongated chamber 174 in the direction of the open end 176 of the first elongated chamber 180 (or the first elongated member 180 is caused to move towards the open end 184 of the second elongated member 180). In this way, the mechanical pressure of the open end 176 of the first elongated member 170 applied to the periphery 26 of the collet cup 24, combined with the oppositely directed pressure of the open end 184 of the second elongated member 180 against the periphery of the retraction moiety 68 of the swagging shell 12, causes the swagging shell 12 to be forced over the collet fingers 22.

The foregoing describes in detail several preferred embodiments of the invention. The foregoing should not be construed, however, as limiting the invention to the particular embodiments describes. Practitioners skilled in the art will recognize numerous other embodiments as well. For a definition of the complete scope of the invention, the reader is directed to the appended claims.

What is claimed is:

1. A system for protectively connecting a plurality of coaxial cable termini to standard coaxial cable connection jacks, wherein each connection jack comprises (1) an externally threaded body with a connection jack aperture, and (2) an internal electrical conductor disposed within, but insulated from, the body proximate to the connection jack aperture, the system comprising:

a. an electrically conductive connection jack connector comprising a connection jack attachment moiety and a cable attachment moiety, the connection jack attachment moiety having a collet structure with a base, a base aperture and a plurality of flared fingers, and the cable attachment moiety having an open ended hollow cylinder which communicates with the collet base aperture, wherein the connection jack attachment moiety is attached tightly around the threaded body of the connection jack and the cable attachment moiety is attached to the coaxial cable terminus in such a way that the cable attachment moiety is in electrical contact with the concentric conductor and in such a way that the central conductor protrudes axially through the collet base aperture, through the connection jack aperture, and is in electrical contact with the internal electrical conductor;

b. a hollow, open-ended swagging shell comprising a compression moiety and a retraction moiety, the compression moiety being disposed tightly over the flared fingers of the connection jack connector thereby applying hoop stress to the flared fingers so as to urge the flared fingers into tight connection with the threaded body of the connection jack; and c. a hollow locking shroud having elongated side walls which define a plurality of locking shroud chambers each with an open end, each locking chamber being attached to one other locking shroud chamber by a flexible web disposed in a curved plane, the locking shroud being disposed in such a way that the side walls can surround each connection jack, connection jack connector and swagging shell.

2. The system of claim 1 wherein the fingers of the connection jacket attachment moiety have an external surface and an internal surface and wherein the internal surface comprises a ridge which is disposed within the external threads of the connection jack.

3. The system of claim 1 wherein the cable connection moiety of the connection jack connector is a mandrel which is disposed between the central conductor and the concentric conductor.

4. The system of claim 3 wherein the mandrel has external threads.

5. The system of claim 4 wherein the external threads of the mandrel have a height which is between about 0.038 inches and about 0.042 inches and wherein the external threads are disposed about the exterior of the mandrel between about 11 threads per inch and about 13 threads per inch.

6. The system of claim 1 wherein the concentric conductor comprises braided metal strands and wherein a plurality of the braided metal strands are disposed between the collet structure and the compression moiety of the swagging shell.

7. The system of claim 4 wherein the swagging shell is cylindrical and the inside diameter of the compression moiety is larger than the inside diameter of the retraction moiety and the inside diameter of the retraction moiety is dimensioned to urge the concentric conductor into tight contact with the mandrel.

8. The system of claim 1 wherein the swagging shell is cylindrical and the outside diameter of the compression moiety is larger than the outside diameter of the retraction moiety.

9. A method of protectively connecting a coaxial terminus to a plurality of standard connection jacks, wherein each connection jack comprises (1) an externally threaded body with a connection jack aperture, and (2) an internal electrical conductor disposed within, but insulated from, the body proximate to the connection jack aperture, the method comprising the following steps:

a. attaching an electrically conductive connection jack connector to the terminus of the cable, the connection jack connector comprising a connection jack attachment moiety and a cable attachment moiety, the connection jack attachment moiety having a collet structure with a base, a base aperture and a plurality of flared fingers, and the cable attachment moiety having an open ended hollow cylinder which communicates with the collet base aperture, the connection jack attachment moiety being attached tightly around the threaded body of the connection jack and the cable attachment moiety being attached to the coaxial cable terminus in such a way that the cable attachment moiety is in electrical contact with the concentric conductor and in such a way that the central conductor protrudes axially through the collet base aperture, through the connection jack aperture, and is in electrical contact with the internal electrical conductor;

b. sliding a hollow, open-ended swagging shell over the flared fingers of the connection jack connector, the swagging shell comprising a compression moiety and a retraction moiety and the compression moiety being dimensioned to tightly surround the flared fingers of the connection jack connector thereby applying hoop stress to the fingers so as to urge the flared fingers into tight connection with the threaded body of the connection jack; and c. disposing a hollow locking shroud having elongated side walls which define a plurality of locking shroud chambers, each locking chamber being attached to one other locking shroud chamber by a flexible web disposed in a curved plane and each with an open end, around each connection jack in such a way that the side walls surround each connection jack, connection jack connector and swagging shell.

* * * * *